US006170771B1

(12) United States Patent
Healey

(10) Patent No.: US 6,170,771 B1
(45) Date of Patent: Jan. 9, 2001

(54) ROCK CRUSHER

(75) Inventor: John Healey, Las Vegas, NV (US)

(73) Assignee: HRW Limited Partnership, Las Vegas, NV (US)

( * ) Notice: Under 35 U.S.C. 154(b), the term of this patent shall be extended for 0 days.

(21) Appl. No.: 09/243,021

(22) Filed: Feb. 2, 1999

Related U.S. Application Data

(63) Continuation-in-part of application No. 09/093,978, filed on Jun. 9, 1998, now abandoned.

(51) Int. Cl.[7] ..... B02C 2/02

(52) U.S. Cl. ..... 241/252; 241/253; 241/254

(58) Field of Search ..... 241/252, 253, 241/254, 220, 37

(56) References Cited

U.S. PATENT DOCUMENTS

| | | | | |
|---|---|---|---|---|
| 2,121,275 | * | 6/1938 | Zober et al. | 241/206 |
| 2,985,391 | * | 5/1961 | Parmele | 241/275 |
| 3,424,388 | * | 1/1969 | Reichel | 241/79.1 |
| 4,196,224 | * | 4/1980 | Falk | 241/253 X |
| 4,257,564 | * | 3/1981 | Pamplin | 241/30 |
| 4,889,428 | * | 12/1989 | Hodson | 241/253 X |

* cited by examiner

*Primary Examiner*—John M. Husar
(74) *Attorney, Agent, or Firm*—Philip J. Anderson; Anderson & Morishita, LLC

(57) ABSTRACT

A device and method are set forth for crushing rocks. The device includes first and second rotors defining therebetween a nip for crushing rocks. A feed opening is provided to feed rock between the rotors to the nip. Angular shoes on the second rotor direct rocks between the openings. In a further aspect, the second rotor may have a non-circular perimeter such as a pentagon or the like.

13 Claims, 9 Drawing Sheets

ROCK CRUSHER

CROSS REFERENCE TO RELATED APPLICATION

This Application is a continuation-in-part application of commonly owned application Ser. No. 09/093,978 filed Jun. 9, 1998 now abandoned.

FIELD OF THE INVENTION

The present invention relates to devices and methods for crushing rocks and the product produced from crushing.

BACKGROUND OF THE INVENTION

It has been known to crush rock to produce, for example, gravel, sand, chips or the like. Manufactured sand, that is sand produced by crushing as opposed to naturally occurring sand, is often specified to be used in manufacturing cement for road construction or the like since, unlike natural sand which has been weathered and the facets worn, manufactured sand has sharp facets which provide for binding in the cement product. Hence, manufacturing sand from crushing rock is an important industry to supply sand and, for that matter, manufactured aggregate for cement.

In addition to manufacturing sand, rocks are crushed to produce gravel and rock chips for use in aggregate and cement and, for example, decorative rock gravel. In the manufacture of gravel it is important to produce a consistent and predictable crushed product such that there is a minimum of non-conforming product, e.g., sand where chips are being manufactured, which must be screened. It would be advantageous to be able to substantially select the product to be produced (whether it be sand, aggregate or chips) and crush the rocks such that a substantial portion of the crushed material falls in the range of the desired product and that a minimum of the product is lost to non-conforming output.

One approach to rock crushing is as shown in Pamplin, U.S. Pat. No. 4,257,564 which has a rotating, planar and circular crushing jaw which operates with a conical jaw. The jaws are spaced to define an annular discharge opening. The conical crushing jaw is defined, in annular fashion, about an axially disposed feed tube which supports the rotating components associated with the conical jaw. Rock is fed axially down the axial tube and the jaws rotated which feeds the rock, through centrifugal force, between the jaws where they are crushed. The lower jaw is round and flat and coacts with the conical upper jaw to define a circular nip for crushing of rock. A drawback to this type of rock crusher is that upper jaw is conical which provides an irregular, non-planar crushing face and which, it turn, increases manufacture and replacement costs of the wear surfaces. The bottom jaw is flat and as a result does not cooperate to urge rock to the nip instead relying completely upon centrifugal force. There is no technique to positively feed and direct rock between the jaws.

There is, therefore, a need for a rock crusher which overcomes the problems of prior rock crushers by, among other features and advantages, positively feeding the rocks to be crushed and which provides for less expensive construction and replacement of wear surfaces.

SUMMARY OF THE INVENTION

Toward this end, a device for crushing rocks is set forth which includes a housing with a feed port to receive the rocks to be crushed and a discharge opening for discharging the crushed product. A first rotor is disposed in the housing and has a first axis. The first rotor defines a first crushing surface. A second rotor is disposed in the housing and has a second axis. The second rotor includes an axial cavity to pass rocks and a face defining at the perimeter thereof a second crushing surface adapted to be spaced from the first crushing surface to define a circumferential nip for crushing rocks therebetween. Opposite the second crushing surface, the second rotor has a cover with at least one feed opening disposed radially from the second axis to admit rocks into the cavity. Means are provided for rotating the first and second rotors about their respective axises to centrifugally direct rocks between the nip for crushing thereof, and for discharging the crushed rocks discharged from the housing.

Accordingly, an axial feed tube is not required and the rocks may be fed into the cavity at one or more spaced locations from the axis of the second rotor. Preferably, the feed openings of the second rotor have associated therewith angular scoops to forcibly direct rocks into the axial cavity for crushing thereof.

In a further aspect, the device includes means to adjust the relative positions of the first and second axises to offset the first crushing surface from the second crushing surface, and to alter the spacing between the crushing surfaces to accommodate larger size rocks and larger size output.

In a further aspect, the first crushing surface is provided angular shoes adapted to direct rocks from the cavity to the nip for crushing thereof.

In still a further embodiment of the present invention, the second crushing surface has a variable radial distance from the second axis to define a non-circular, polygonal, circumferential nip for crushing rocks. In the preferred embodiment, the second crushing surface is hexagonal which acts not only to impose forces normal to the crushing surfaces but also provides circumferential and axial forces to further act to crush and guide rocks through the nip. The imposition of these forces in addition to the centrifugal forces urging the rocks through the nip provides for efficient crushing of the rocks and the production of a substantially predictable product.

BRIEF DESCRIPTION OF THE DRAWINGS

These, and other features and advantages, will become appreciated as the same becomes better understood with reference to the specification, claims and drawings wherein:

DESCRIPTION

Figure 1:
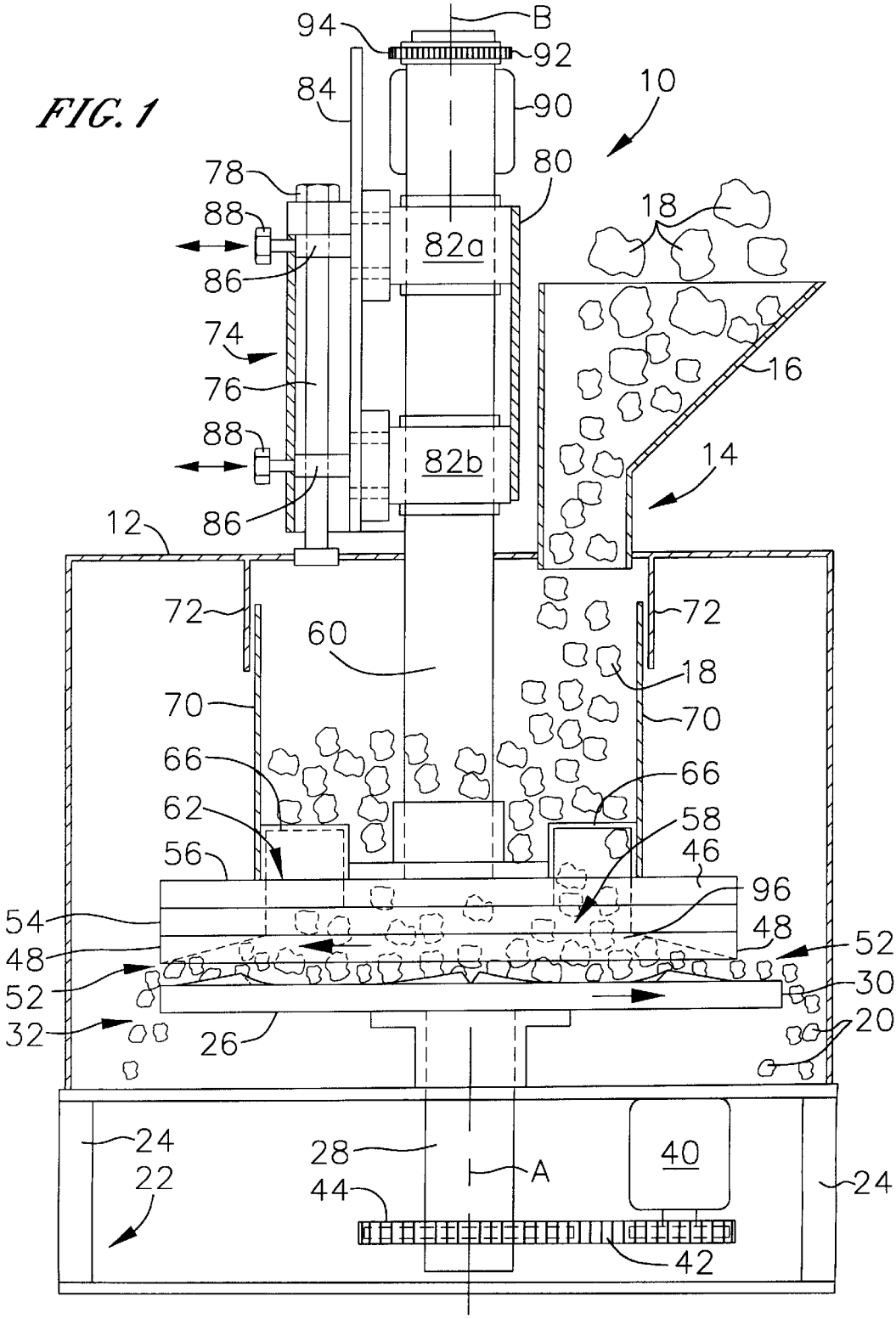
FIG. 1 is a partial section view of the device according to the present invention illustrating the feed of rocks therethrough.
Figure 2:
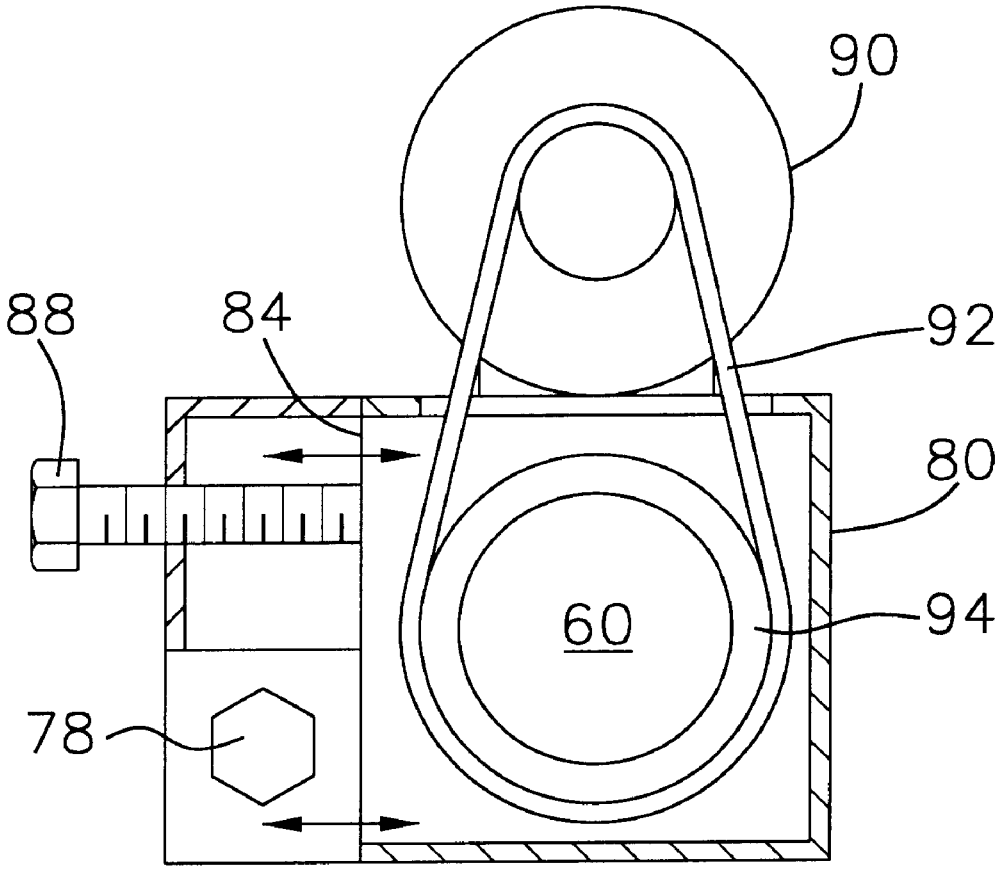
FIG. 2 is a top view of a portion of the device of FIG. 1 illustrating the adjustment of the relative positions for the crushing surfaces.

Turning to the drawings, FIG. 1 shows a device 10 according to one embodiment of the present invention. The device 10 includes a closed housing 12 adapted to contain the components as hereinafter described. At the top the housing 12 there is a feed port 14 which may have a funnel 16 for feeding of rocks 18 into the housing 12 for crushing thereof. At the lower portion of the housing is a discharge (not shown) from which the crushed material 20 falls for collection thereof.

The housing 12 is supported above the ground on a stand 22 including a plurality of legs 24 to raise the housing 12 above the ground for collection of the crushed material 20 from the device 10.

Figure 6:
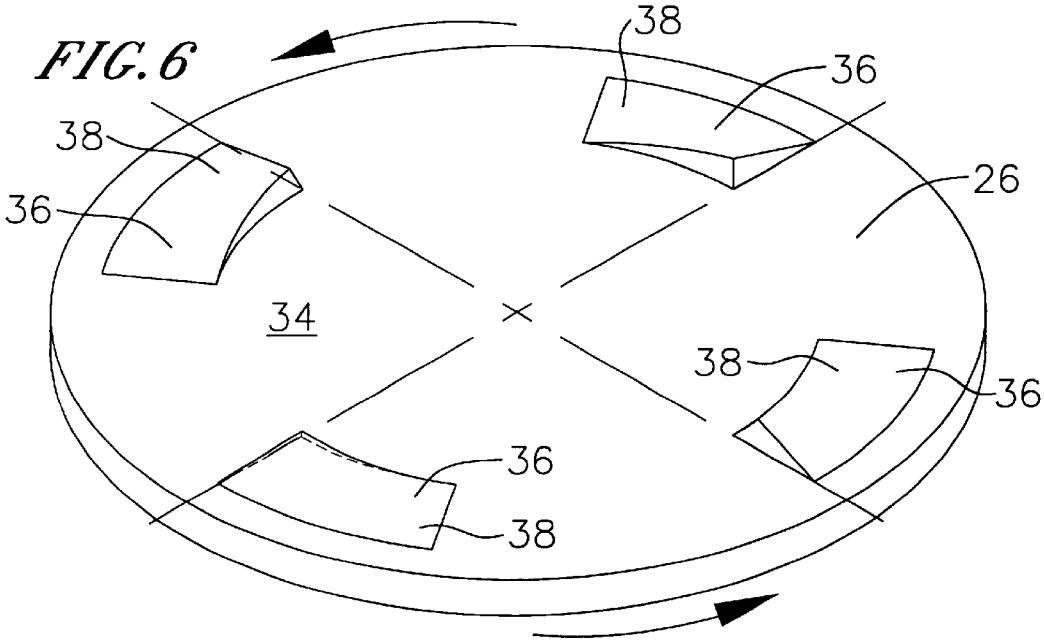
FIG. 6 is a top perspective view of the first rotor crushing surface.
Figure 7:
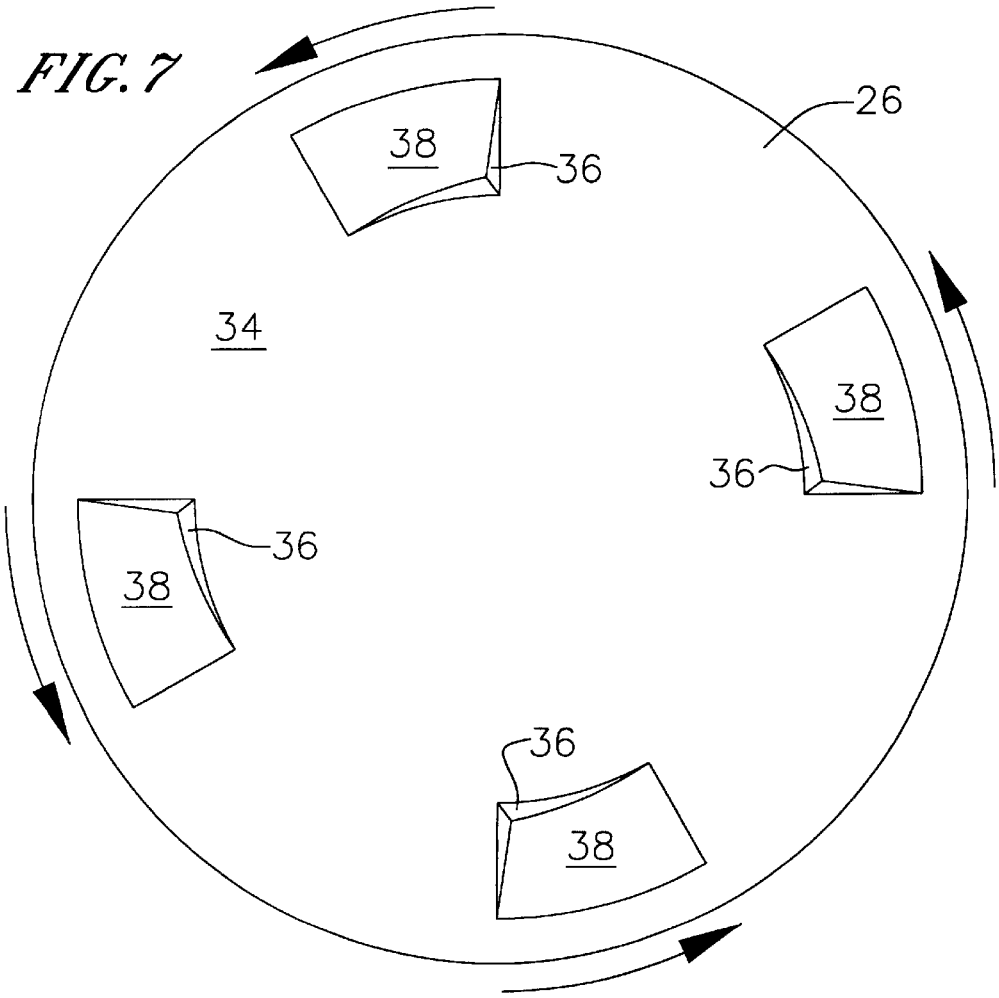
FIG. 7 is a plan view of the top surface of first rotor.

With reference to FIGS. 1, 6 and 7, the device 10 includes a first rotor 26 mounted on a shaft 28 which is journaled for rotation about an axis A. Preferably, the housing 12 is cylindrical and is arranged coaxial with the shaft 28. The first rotor 26 is circular, flat having a diameter to locate the perimeter 30 inboard of the housing 12 to provide an annular space 32 for the crushed material 20 to fall to the bottom of the housing 12 to be discharged therefrom. As shown in the drawings, the first rotor 26 has a generally planar first crushing surface 34 against which the rocks 18 are crushed in a manner to be described below. As illustrated in FIGS. 6 and 7, the first crushing surface 34 may include a plurality of shoes 36 tapered to define a directing surface 38 angled into the direction of rotation of the first rotor 26 and sloping outwardly and downwardly to merge with the planar first crushing surface 34. The shoes 36, and more particularly the directing surfaces 38 thereof, are adapted, when the first rotor 26 is rotated in a counter-clockwise direction as shown in FIGS. 6 and 7, to engage and urge the rocks outwardly in combination with centrifugal forces imposed on the rocks as hereinafter described.

Returning to FIG. 1, the first rotor 26 is journaled to the housing 12 for rotation about axis A. To drive the first rotor 26, a first motor 40 is provided and is coupled by drive means such as a chain 42 meshing with a sprocket 44 to rotate the shaft 28 of the first rotor 26 about axis A. Preferably the drive means encompassed by the first motor 40, chain 42 and sprocket 44 rotates the shaft 28 at approximately 1,760 rpm. However, it is to be understood that the first motor 40 could be variable speed in order to alter the speed of rotation of the first rotor.

Further, depending upon the diameter of the rotors, the speed may be increased or decreased.

To cooperate with the first rotor 26, the device 10 includes a second rotor 46 having an annular, conical ring 48 defining a second crushing surface 50 (FIG. 5B) adapted to be spaced from the first crushing surface 34 to define a nip 52 for crushing of the rocks 18.

Figure 4A:
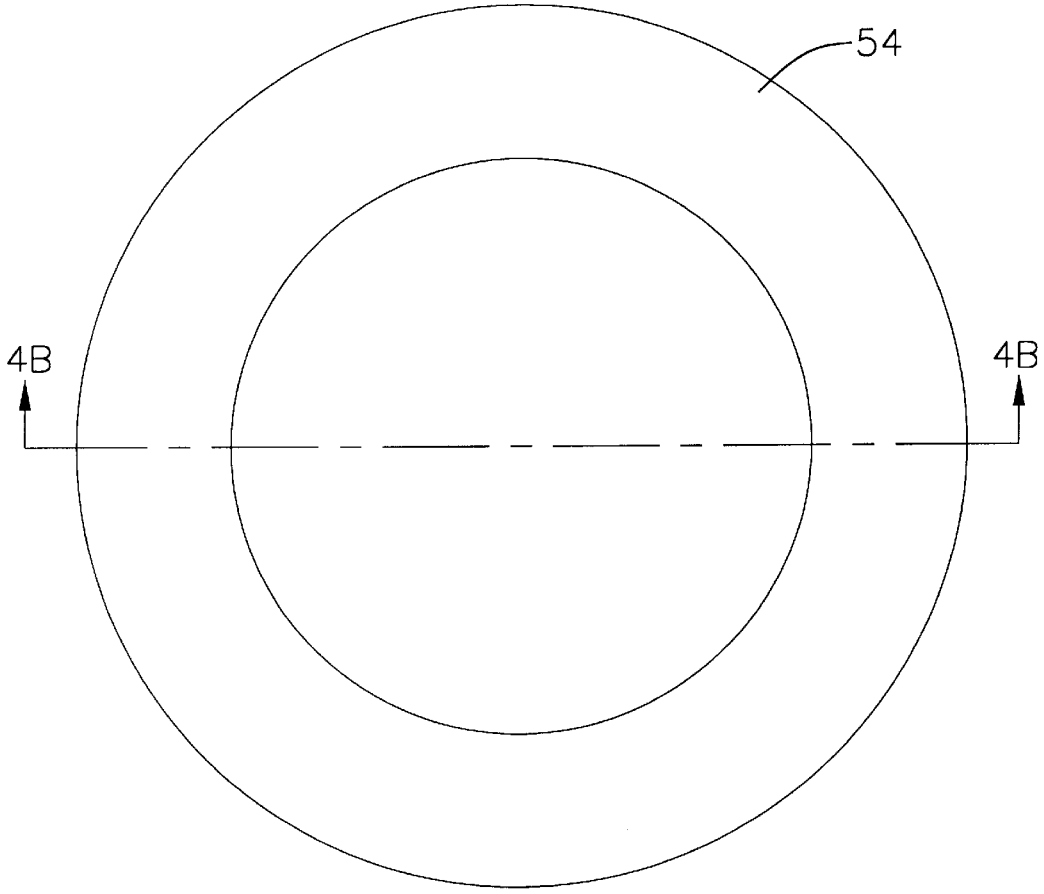
FIG. 4A is a plan view of a spacer ring for the second rotor.
Figure 4B:
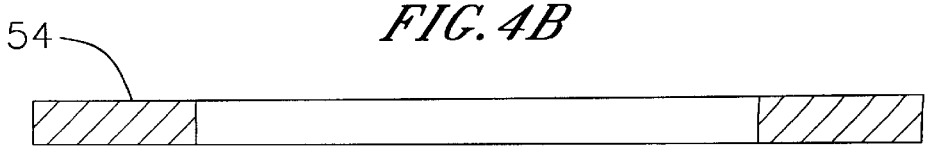
FIG. 4B is a section view of the spacer ring for the second rotor taken along line 4B—4B of FIG. 4A.
Figure 5A:
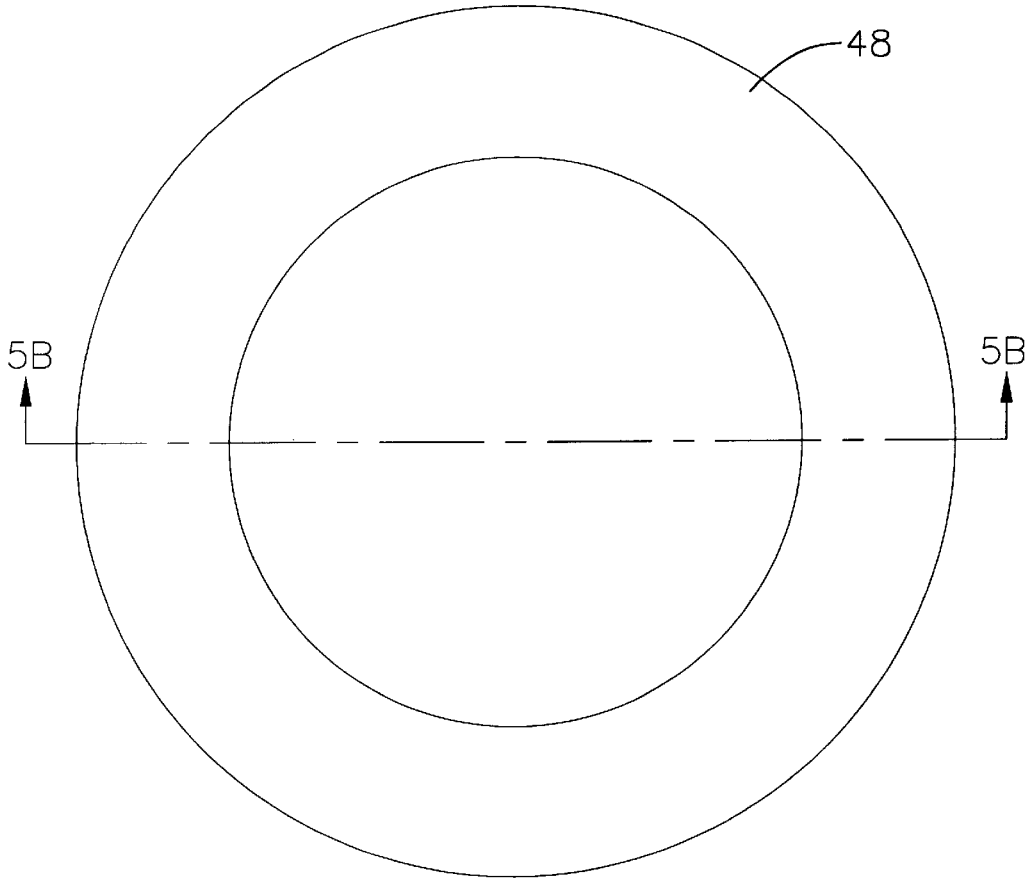
FIG. 5A is a plan view of the crushing ring for the second rotor.
Figure 5B:
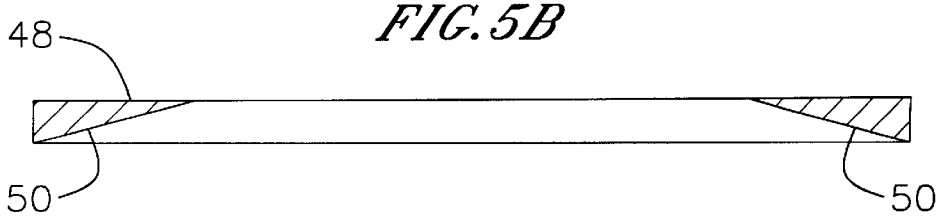
FIG. 5B is a section view of the crushing ring for the second rotor taken along line 5B—5B of FIG. 5A.

The second rotor 46 as shown in FIGS. 5A, 5B is defined, in part, by an annular conical ring 48 which defines a conical second crushing surface 50 adapted to cooperate with the first crushing surface 34 to define the crushing nip 52. The annular conical ring 48 including the second crushing surface 50 is coupled to an annular spacing ring 54 as shown in FIGS. 1, 4A and 4B which is in turn secured to a generally closed, circular top plate 56 shown in FIGS. 3A, 3B. The outside perimeters of the annular conical ring 48, spacing ring and top plate 56 are of equal outside diameter and are concentrically aligned along a second axis B. The annular space defined by the spacing ring 54 and annular concentric ring 48 and as covered by the top plate 56 defines a crushing chamber 58 adapted to receive rocks 18 for crushing thereof.

To provide for rotation, the second rotor 46 includes a shaft 60 aligned with the second axis B and secured at one end to the top plate 56, the other end extending from the housing 12 as shown in FIG. 1. As will be described below, the shaft 60 is adapted to be rotated about the second axis B and can be vertically and horizontally displaced, with reference to FIG. 1, to alter the size of the nip 52 and provide, if desired, an offset between the first and second axises A and B.

Figure 3A:
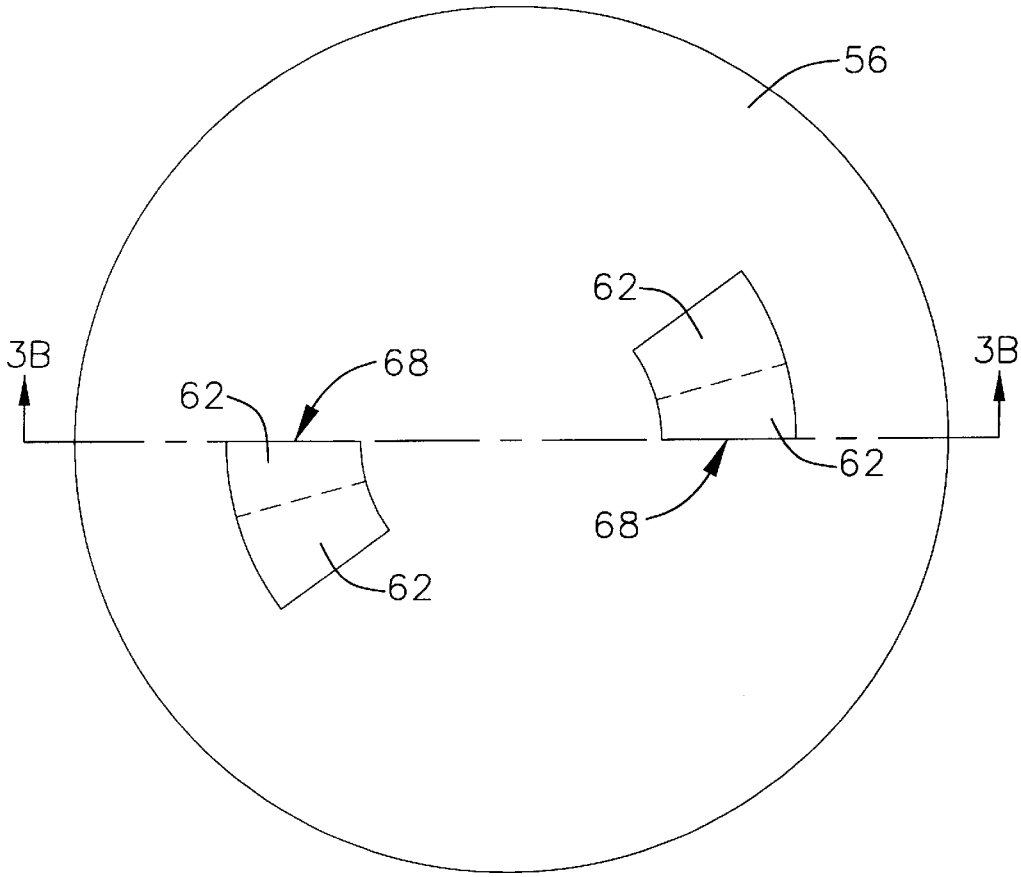
FIG. 3A is a top view of the second rotor.
Figure 3B:
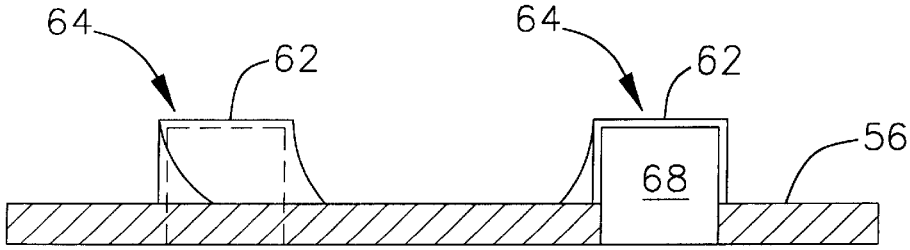
FIG. 3B is a section view of the top of the second rotor taken along line 3B—3B of FIG. 3A.

With reference to FIGS. 1, 3A and 3B, the top plate 56 includes one and preferably a plurality of feed openings 62 disposed radially from the second axis B and is best shown in FIG. 1 from the shaft 60. Rocks 18 fed into the feed port 14 are in turn admitted through the feed openings 62 into the crushing chamber 58 for crushing thereof. While the feed openings 62 may simply be openings in the top plate 56, preferably the top plate 56 includes a plurality of shoulders 64 each adapted to urge rocks 18 through the feed openings 62 in response to rotation of the second rotor 56. Accordingly, the shoulders 64 may be embodied as tapered scoops 66 each having a mouth 68 directed into the direction of rotation of the second rotor 46, the scoops 66 tapering from the mouth 68 to the feed opening 62. Accordingly, and in response to rotation of the second rotor 46, the scoops 66 direct rocks into their respective feed openings 62 and therethrough into the crushing chamber 58. The scooping action imposes an axial force upon the rocks in the crushing chamber 58 to assist in urging them to the nip 52 for crushing thereof.

Also secured to the top plate 56 is a cylindrical bin 70 aligned coaxially with the second axis B and adapted to rotate with the second rotor 46. Thus it can be appreciated from FIG. 1, rocks 18 fed into the feed port 14 fall into the bin 70 as it rotates with the second rotor 46 whereupon the rocks 18 are fed through the feed openings 62 into the crushing chamber 58.

To cooperate with the bin 70 to confine the rocks therein, the housing 12 includes a fixed, cylindrical skirt 72 projecting downwardly to overlap the top of the bin 70 to prevent rocks 18 from being ejected from the rotating bin 70.

To support the second rotor 46 for rotation thereof, the device 10 includes a support carriage 74 movably mounted to the housing 12. To support the support carriage 74, the housing mounts one or more pillars 76 in a position to upstand from the housing 12. The support carriage 76 is, in turn, movably mounted to the pillars 76 for vertical motion along the second axis B and for motion transverse to the second axis B. Each of the pillars 76 is internally threaded to receive a vertical adjustment bolt 78 which in turn mounts the support carriage 76. Accordingly, rotation of the vertical adjustment bolt 78 displaces the support carriage 74 and the shaft 60 journaled thereby vertically which in turn adjusts the spacing of the nip 52.

The support carriage 74 has a frame 80 which is in turn mounted to the vertical adjustment bolt 78.

Disposed within the support carriage 74 are bearings 82*a, b* which journal the shaft 60 for rotation about axis B. The bearings 82*a, b* are in turn mounted to a support panel 84. The panel 84 includes a plurality of threaded sleeves 86 which are likewise supported on the vertical support pillars 76. Offset adjustment bolts 88 are in turn disposed between the frame 80 and threaded sleeves 86. Accordingly, rotation of the offset adjustment bolts 88 displaces the support carriage 74, its frame 80 and the journaled shaft 60 to displace the axis B relative to the axis A. For example, the offset position of the axis B may be adjusted to be collinear with the first axis A or may be offset as shown in FIG. 1. The offset provided between the axes A, B induces a radial component to the centrifugal forces induced by rotation of the first and second rotors 34, 46 and the rolling or scrubbing forces induced by the relative rotation between the first and second rotors 34, 50. It has been found that for certain types of rocks and the desired output, that an offset can advantageously crush the rocks 18.

To rotate the shaft 60, the support carriage 74 also mounts a motor 90 coupled to the shaft 64 rotation as by a chain 92 and sprocket 94. The motor 90, like the first motor 40, may be variable speed and adapted to, for example, rotate the shaft 60 and second rotor 46 at between 60 and 180 rpm.

With reference to FIGS. 1, 6 and 7, in the preferred embodiment the first rotor 34 is rotated in a counter-clockwise direction whereas the second rotor 46 is rotated in a clockwise direction to provide a maximum of the relative speeds between the first and second crushing surfaces 34, 50. If desired, the first rotor 26 may not include the shoes 36 and the first motor 40 may be reversible whereby the direction as well as the relative speeds between the rotation of the first and second rotors 34, 50 may be altered. That is, the first rotor 26 may be rotated in the same clockwise direction as the second rotor 46 or in a counter-direction.

With the components of the device 10 described above, its operation will now be set forth.

By adjusting the vertical adjustment bolt 78, the space at the nip 52 may be adjusted taking into account several factors. One factor is that the space at the entrance 96 of the nip 96 must be sufficiently large to accept the largest size of rock 18 fed into the device 10. The second consideration is that at the discharge 98 of the nip 50, the spacing between the first and second crushing surfaces 34, 50 can be no greater than the maximum size of crushed material 20 to be discharged from the device 10. That is, if chips having a size of approximately one-half inch are desired, the first and second rotors 26, 46 should be adjusted such that the discharge 98 of the nip 52 is approximately one-half inch. If crushed sand is desired, then the discharge 98 should be made smaller to adequately crush the rocks 18 into the smaller size. It is to be understood, depending upon the nature of the rocks fed into the device 10 that the angle of the annular, conical ring 48 defining the second crushing surface 50 may be altered so as to receive the rocks 18. It has been found that an angle formed with the first crushing surface 34 of approximately 90 to 100 provides for satisfactory crushing of the rocks.

After the nip 52 has been adjusted, the offset between the first and second axis A, B is selected and set. Preferably the maximum offset permitted is only to the degree that the perimeter of the second rotor 46 aligns with the perimeter of the first rotor 40 as shown in FIG. 1. Thereafter, the first and second rotors 26, 46 are engaged by their first and second motors 40, 90 and rotation is begun. When the first and second rotors 26, 46 have reached their speeds, rocks 18 are fed into the feed port 14 whereupon they fall into the bin 70. Centrifugal force caused by rotation of the second rotor 46 urges the rocks 18 to the outside of the bin 70. Gravity urges the rocks downwardly in the bin to be received into the scoops 66 and feed openings 62 and into the crushing chamber 58. The centrifugal force on the rocks 18 in the crushing chamber, along with any axial loading induced by the scoops 66 and any forces imposed by the directing surface 38 on the shoes 36 urge the rocks 18 from the crushing chamber 38 through the annular nip 52 for crushing between the first and second crushing surfaces 34, 50. As stated above, the rocks are crushed due to the loads of the first and second crushing surfaces 34, 50 imposed due to the centrifugal force on the rocks 18, the force induced by the scoops 66 and directing surfaces 38 as well as the circumferential buffing or rolling action caused by the relative rotation between the first and second rotors 34, 46. The pinching between the first and second crushing surfaces 34, 50 created by the nip 52 crushes the rocks 18 into the crushed material 20. The crushed material 20, induced by centrifugal force, is ejected outwardly to the housing 12 where it falls by gravity for discharge therefrom.

Tables 1, 2 and 3 below show sample outputs of the device 10 when the first and second rotors 26, 46 are rotated in opposite and in the same direction with the first rotor 26 operating at a constant speed of 1,760 rpm.

TABLE 1

ROTORS IN OPPOSITE DIRECTION BOTTOM ROTOR AT 1760 RPM
TOP ROTOR SPEEDS 60 RPM, 120 RPM AND 180 RPM
¼" NIP SPACE

| | 60 RPM | | 120 RPM | | 180 RPM | |
|---|---|---|---|---|---|---|
| Sieve Size | % Ret. | % Pass | % Ret. | % Pass | % Ret. | % Pass |
| ½" | | 100 | | 100 | | 100 |
| ⅜" | 3.4 | 96.5 | 1.9 | 98.1 | 3.0 | 97.0 |
| No. 4 | 43.6 | 52.9 | 41.1 | 57.0 | 42.1 | 54.9 |
| No. 8 | 23.0 | 29.9 | 24.4 | 32.6 | 25.8 | 29.1 |
| No. 10 | | | | | | |
| No. 16 | 11.3 | 18.6 | 12.3 | 20.3 | 11.6 | 17.5 |
| No. 30 | 5.7 | 12.9 | 6.6 | 13.7 | 5.3 | 12.2 |
| No. 40 | | | | | | |
| No. 50 | | | | | | |
| No. 100 | 5.8 | 7.1 | 6.2 | 7.5 | 5.1 | 7.1 |
| No. 200 | 1.5 | 5.6 | 1.6 | 5.9 | 1.3 | 5.8 |

TABLE 2

ROTORS IN OPPOSITE DIRECTION BOTTOM ROTOR AT 1760 RPM
TOP ROTOR SPEEDS 60 RPM, 120 RPM AND 180 RPM
¼" NIP SPACE

| | 60 RPM | | 120 RPM | | 180 RPM | |
|---|---|---|---|---|---|---|
| Sieve Size | % Ret. | % Pass | % Ret. | % Pass | % Ret. | % Pass |
| ½" | | 100 | | 100 | | 100 |
| ⅜" | 3.5 | 96.6 | 4.6 | 95.3 | 2.5 | 97.5 |
| No. 4 | 42.7 | 53.9 | 43.2 | 52.1 | 46.5 | 51.0 |
| No. 8 | 22.0 | 31.7 | 23.7 | 28.4 | 22.7 | 28.3 |
| No. 10 | | | | | | |
| No. 16 | 11.5 | 20.4 | 10.8 | 17.6 | 10.8 | 17.5 |
| No. 30 | 6.2 | 14.2 | 5.3 | 12.3 | 5.5 | 12.0 |
| No. 40 | | | | | | |
| No. 50 | | | | | | |
| No. 100 | 6.4 | 7.8 | 5.5 | 6.8 | 5.5 | 6.5 |
| No. 200 | 1.3 | 6.5 | 1.4 | 5.4 | 1.2 | 5.3 |

TABLE 3

ROTORS IN SAME DIRECTION BOTTOM ROTOR AT 1760 RPM TOP ROTOR SPEEDS 60 RPM, 120 RPM AND 180 RPM ¼" NIP SPACE

| | 60 RPM | | 120 RPM | | 180 RPM | |
|---|---|---|---|---|---|---|
| Sieve Size | % Ret. | % Pass | % Ret. | % Pass | % Ret. | % Pass |
| ½" | | | | 100 | | 100 |
| ⅜" | 7.0 | 93.1 | 7.6 | 92.5 | 8.6 | 91.3 |
| No. 4 | 47.2 | 45.9 | 48.6 | 43.9 | 47.1 | 44.2 |
| No. 8 | 22.0 | 23.9 | 19.7 | 24.2 | 19.4 | 24.8 |
| No. 10 | 3.2 | 20.7 | 3.0 | 21.2 | 3.4 | 21.4 |
| No. 16 | 6.1 | 14.6 | 5.9 | 15.3 | 6.5 | 14.9 |
| No. 30 | 3.9 | 10.7 | 4.0 | 11.3 | 3.9 | 11.0 |
| No. 40 | 1.1 | 9.6 | 1.2 | 10.1 | 1.7 | 9.3 |
| No. 50 | .9 | 8.7 | 1.0 | 9.1 | .6 | 8.7 |
| No. 100 | 1.7 | 7.0 | 1.8 | 7.3 | 1.6 | 7.1 |
| No. 200 | 2.0 | 5.0 | 2.2 | 5.1 | 2.2 | 4.9 |

As can be appreciated, the device 10 according to the present invention, where sand is desired, can produce roughly 90% sand (no. 4 Sieve and smaller) in most instances. The predictable production of sand, where sand is desired, provides for efficient production.

Figure 8:
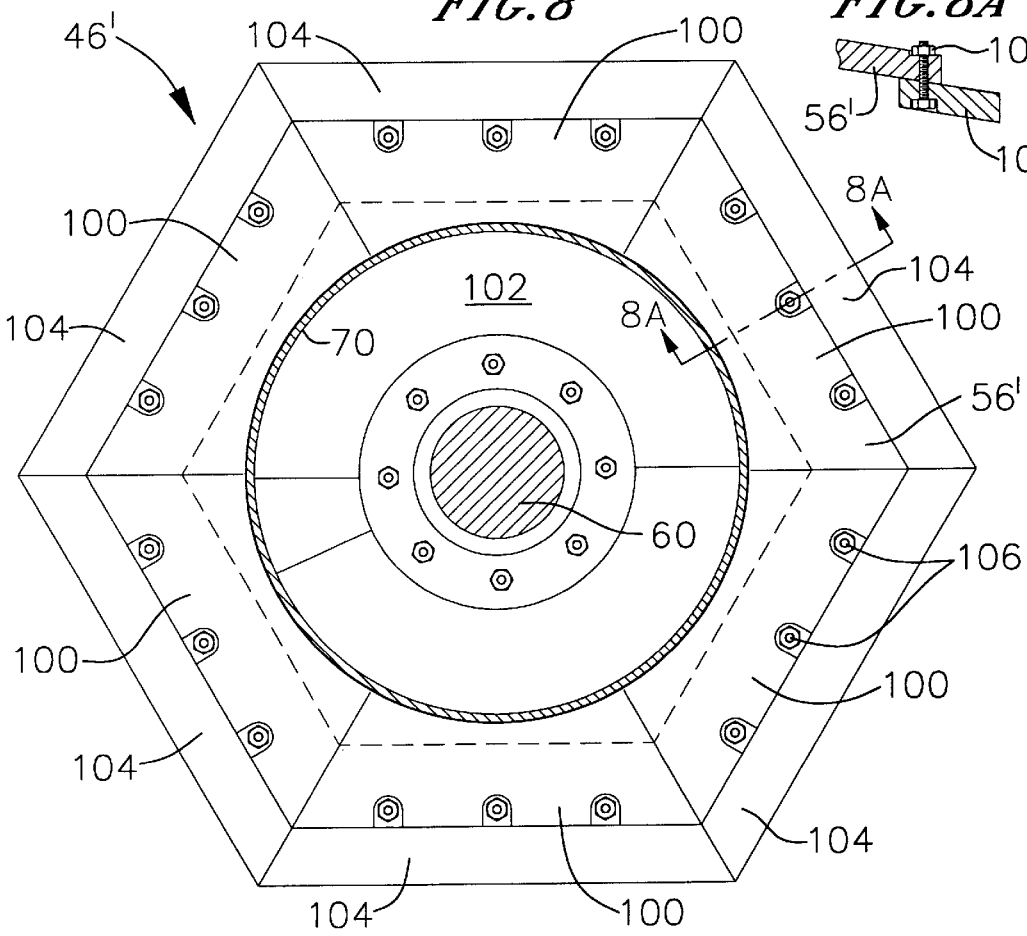
FIG. 8 is a top plan view of a further embodiment of the second rotor.
Figure 8A:
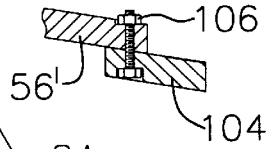
FIG. 8A is a partial section view of the second rotor of FIG. 8 taken along line 8A—8A of FIG. 8.
Figure 9:
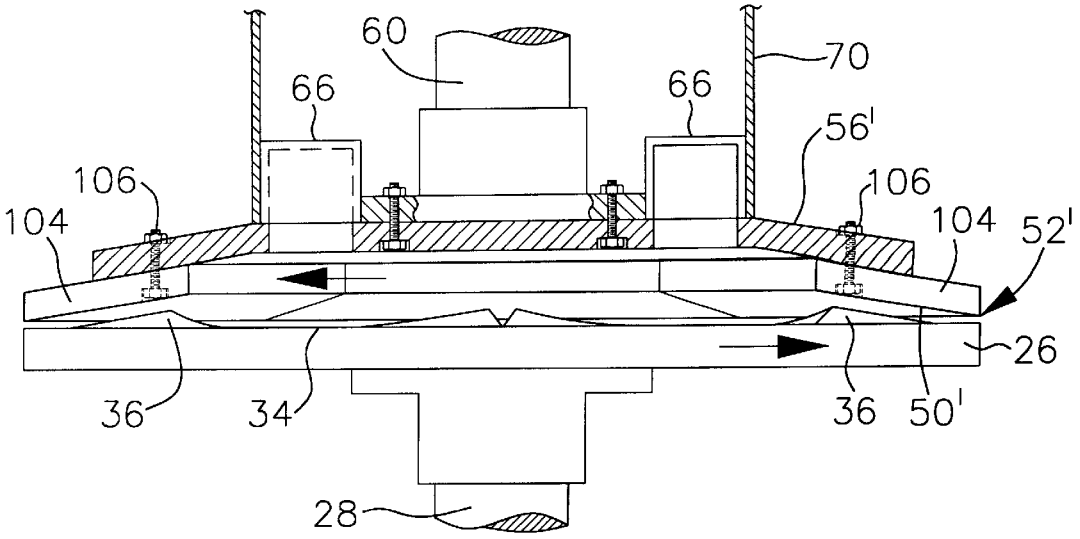
FIG. 9 is a partial section view of the device incorporating the second rotor of FIG. 8.

Turning to FIGS. 8 through 9, a further embodiment of the present invention is shown. Like components bear the same reference numerals.

According to this embodiment, the second rotor 46' includes a hexagonal top plate 56' defining six depending wings 100 which extend downwardly at an angle of between 9° and 10° from a circular and planar center 102. The perimeter of the circular center 102 corresponds with the diameter of the bin 70 to define the bottom thereof. Scoops 66 may be provided for the second rotor 46'.

To define the second crushing surface 50', the second rotor 46' includes secured to each of the wings 100 replaceable crushing plates 104 which are adapted to conform to the overall hexagonal shape of the second rotor 46'. Fasteners 106 secure each of the crushing plates 104 to the corresponding wings 100 and accordingly it is to be understood that by removing the fasteners 106, the crushing plates 104 can be replaced for the second rotor 46'. Each of the crushing plates 104 is secured to their corresponding wings 100 to depend again, preferably, an angle of between 9° to 10° relative to the first crushing surface 34. Accordingly, it is to be understood that the perimeter of the second rotor 46' is of a varying radius or diameter from axis A and defines a non-circular nip 52' for the device 10. As is also to be understood, upon rotation of the shaft 60, and by virtue of the variable perimeter of the second rotor 46', that rocks trapped in the nip 52' will be urged to move, relative to the perimeter of the rotors, radially inwardly and outwardly as the second rotor 46' rotates. Furthermore, the angles defined at the joinder of adjacent crushing plates 104 act substantially as a funnel to funnel rocks between the crushing plates 104 of the second crushing surface 50' for crushing thereof. It has been found that by using the hexagonal second rotor 46' as shown in FIG. 8, efficient crushing of rock 18 is obtained.

Figure 10:
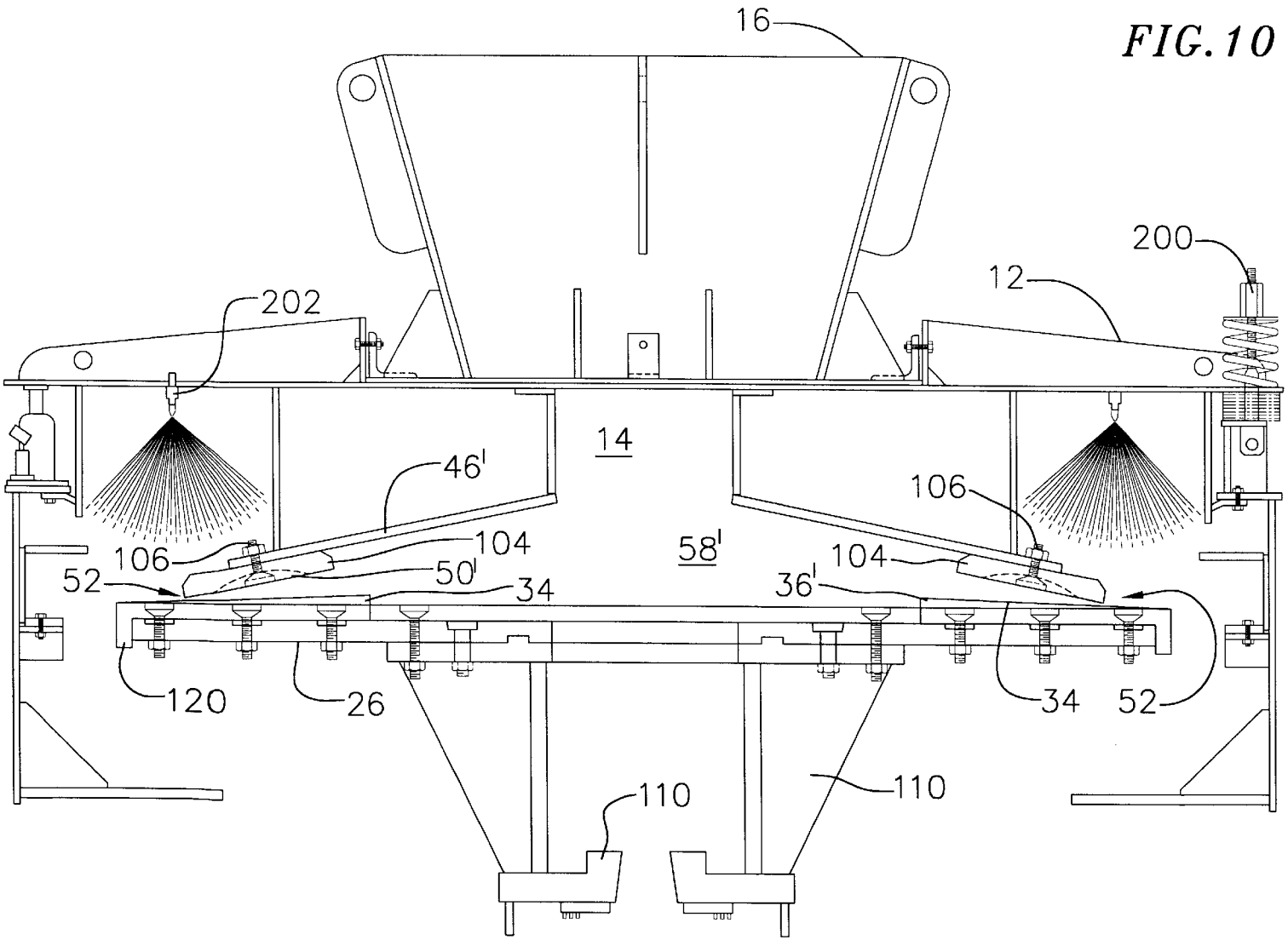
FIG. 10 is a side section view of a further embodiment of a crusher according to the present invention.
Figure 11:
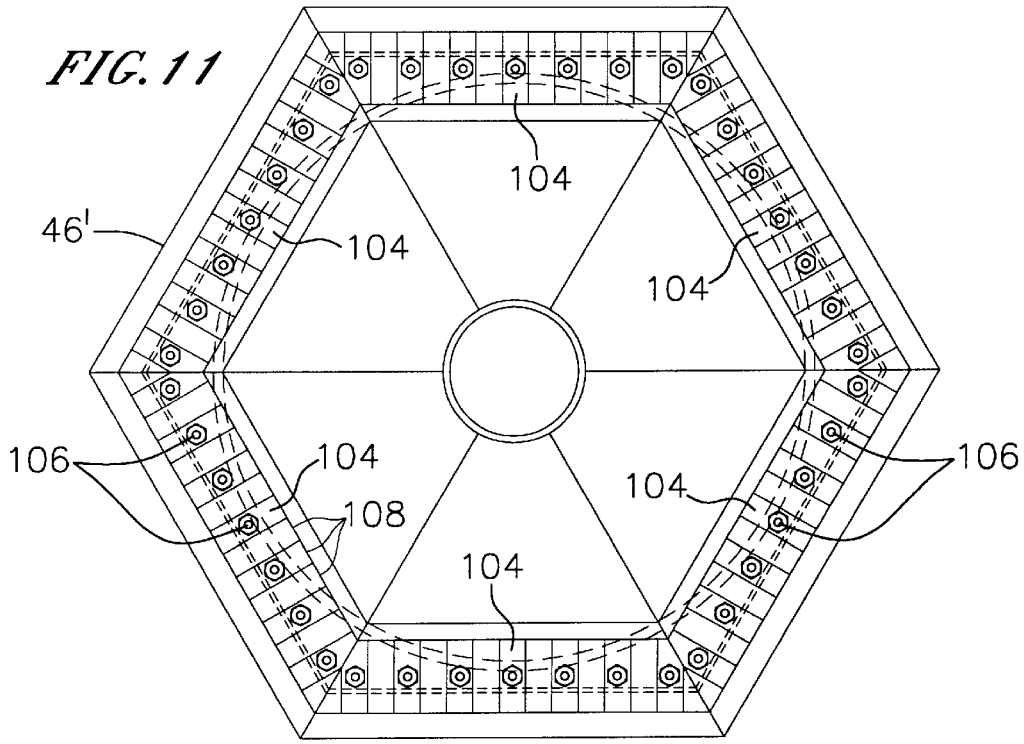
FIG. 11 is a top view of the top plate and first rotor according to the embodiment of FIG. 10.
Figure 12:
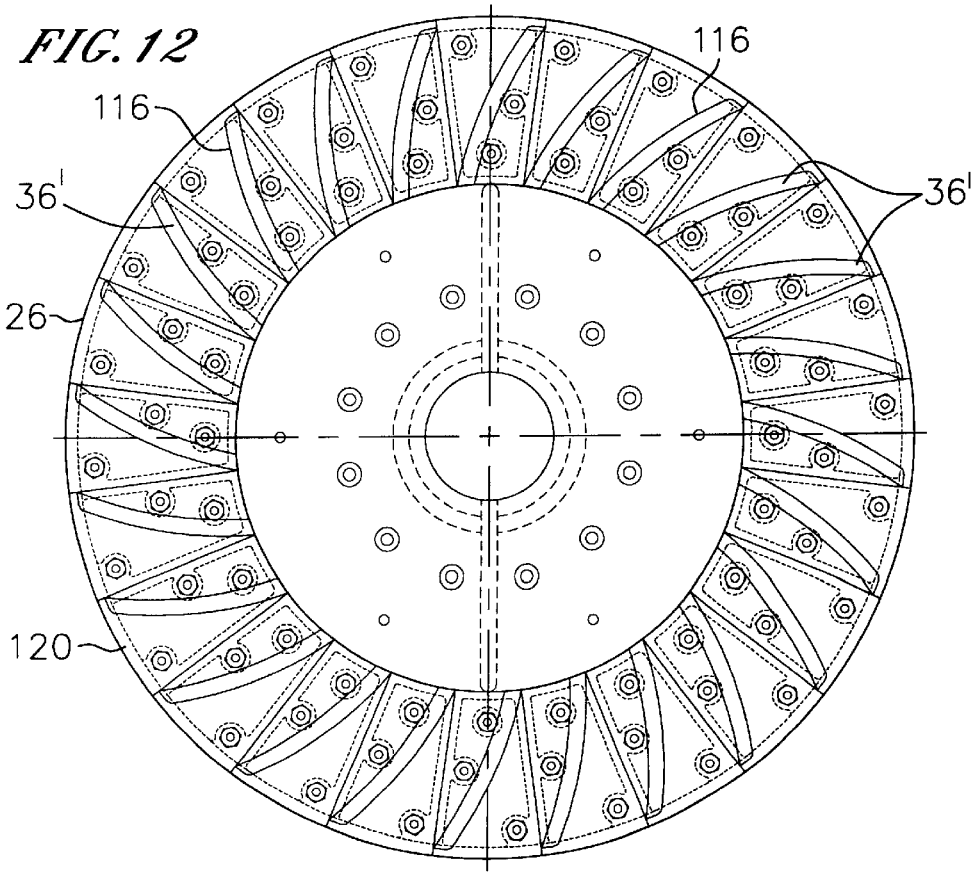
FIG. 12 is a top view of the first crushing surface and shoes of the embodiment of FIG. 10.

With reference to FIGS. 10–12 a further embodiment of a crusher according to the present invention is shown. According to this embodiment a funnel 16 is provided on the housing 12 to direct rocks fed into the housing to a feed port 14'.

The feed port 14' directs the rock into the conical crushing chamber 58' defined between a second rotor 46', which is preferably fixed but may be free wheeling or driven for rotation, and a rotatable first rotor 26. As with the previous embodiment, the second rotor 46' has radially projecting wings each of which mounts a crushing plate 104. The crushing plates 104 may each consist of single plate or be fashioned from a plurality of sub-plates 108 secured to the wing by fasteners 106. As shown, the second rotor 46' and crushing plates 104 define a hexagonal second crushing surface 50' and nip 52 between the crushing plates 104 and the first crushing surface 34. The crushing plates 104 are mated at adjoining sides to provide a continuous, hexagonal, second crushing surface 50'.

As can be appreciated the crushing plates 104 are substantially planar and thus can easily be manufactured and replaced. At the second crushing surface 50' the fasteners 106 are recessed to prevent damage thereto.

The first rotor 26 is driven by a first motor 40 (not shown in FIGS. 10–12) for rotation. Supporting struts 110 are coupled between the first rotor 26 and a shaft plate 112 which is, in turn, coupled to the first motor, provides for the rotation of the first rotor 26.

To direct the rock fed into the crushing chamber 58 the first rotor 26 includes a plurality of shoes 36' as shown in FIG. 12. Each shoe 36' has, in plan view, an arcuate leading edge 116 which also slopes downwardly toward the periphery of the second rotor 46', inside out as shown in FIG. 10. A circular fastening plate 120 is adapted to secure the shoes 36' to the first rotor 26. Each shoe 36' urges the rocks outwardly into the nip 52 between the first and second rotors 26, 46' and the leading edge 116 in cooperation with the second rotor 46' and the crushing plates 104 thereof provides a varying nip 52 to crush the rocks.

The hexagonal shape of the second crushing surface 50' and nip 52 provide for a nip 52 whose position varies radially with respect to the axis of the first rotor 26. Thus when the first rotor 26 is rotated the rocks are subject to a radial scrubbing action as a variable radial distance to the nip 52 is provided by the polygonal shape of the second crushing surface 50'. In that the crushing plates 104 are angled downwardly to the nip 52, a further compaction force is imposed on the rocks.

Still further the forces imposed by the shoes 36 along with centrifugal forces impose a radial force upon the rocks to direct them into the nip 52. The aforesaid forces contribute to the efficient crushing of the rocks.

Further the sloping of the leading edges 116 of the shoes 36 provide with the second crushing surface 50' a taper to the nip 52 to crush rocks.

With reference to FIG. 10, the space defined by the nip 52 may be adjusted by adjusting struts 200. Use of these struts 200 raises the second rotor 46' relative to the first rotor 26 to adjust the nip 52 to the desired spacing.

To control dust, spry nozzles 202 may be provided about the periphery of the nip 52.

It is to be understood that while the second rotor 46' may be circular or hexagonal as described above, it could also be triangular, square or oblong to provide a variable radius to induce the rocks to move inwardly and outwardly for crushing thereof.

While I have described certain embodiments of the present invention, it is to be understood that it is subject to many modifications and changes without departing from the spirit and scope of the claims.

I claim:

1. A device for crushing material comprising:

a housing having a feed port to receive into the housing material to be crushed and a discharge for crushed material;

a first rotor disposed in the housing having a first axis and defining a first crushing surface;

a second rotor disposed in the housing having a second axis, said second rotor including an axial cavity to pass material, a face defining a second crushing surface, said second crushing surface being polygonal to have a variable radial distance from said second axis and adapted to be spaced from the first crushing surface to define a polygonal, circumferential nip for crushing material between said first and second crushing surfaces; and means for rotating the first rotor to centrifugally direct material between said nip for crushing thereof, said crushed material discharged from said housing discharge.

2. The device of claim 1 wherein said first and second axes are collinear.

3. The device of claim 1 wherein said second crushing surface is defined by at least three substantially linear crushing plates arranged tangential to a radius extending from the second axis.

4. The device of claim 1 wherein the second crushing surface is defined by four substantially linear crushing plates arranged in a substantially rectangular configuration.

5. The device of claim 1 wherein the second crushing surface includes five substantially linear crushing plates arranged to define a pentagon.

6. The device of claim 1 wherein the second crushing surface includes six substantially linear crushing plates to define a hexagon.

7. The device of claim 1 wherein the second crushing surface is polygonal and disposed at an angle relative to the second axis to define a radially converging nip between the first and second crushing surfaces.

8. The device of claim 1 including a plurality of shoes disposed on the first rotor radially inward from said nip and having a circumferentially and radially tapered surface to direct the material toward the nip.

9. The device of claim 8 wherein said shoes have an arcuate leading edge including said tapered surface.

10. The device of claim 1 wherein said second crushing surface has a shape to define a circumferential nip having a shape selected from the group consisting of triangular, rectangular, pentagonal, and hexagonal.

11. A device for crushing material comprising:

a housing having a feed port to receive into the housing material to be crushed and a discharge for crushed material;

a first rotor disposed in the housing having a first axis and defining a first crushing surface;

a second rotor disposed in the housing having a second axis, said second rotor including an axial cavity to pass material into a space between said first and second rotors, a plurality of planar crushing plates removably secured to the second rotor in an adjoining relationship face to define a polygonal second crushing surface, said second crushing surface spaced from the first crushing surface to define a circumferential nip for crushing material between said first and second crushing surfaces; and means for rotating the first rotor to centrifugally direct material between said nip for crushing thereof, said crushed material discharged from said housing discharge.

12. The device of claim 11 including at least three crushing plates disposed to define a polygonal second crushing surface.

13. A device for crushing material comprising:

a housing having a feed port to receive into the housing material to be crushed and a discharge for crushed material;

a first rotor disposed in the housing having a first axis and defining a first crushing surface;

a second rotor disposed in the housing having a second axis, said second rotor including an axial cavity to pass material, a face defining a second crushing surface, said second crushing surface having a polygonal shape selected from a group consisting of triangular, rectangular, pentagonal and hexagonal to have a variable radial distance from said second axis and adapted to be spaced from the first crushing surface to define a circumferential nip for crushing material between said first and second crushing surfaces; and means for rotating the first rotor to direct material between said nip for crushing thereof, said crushed material discharged from said housing discharge.

* * * * *